United States Patent [19]

Thiel et al.

[11] Patent Number: 4,917,822

[45] Date of Patent: Apr. 17, 1990

[54] GRAPHITE-CONTAINING CONDUCTIVE SUSPENSION FOR PICTURE TUBES

[75] Inventors: Norbert Thiel, Bad Säckingen; Rolf Zondler, Straubing-Ittling, both of Fed. Rep. of Germany

[73] Assignee: Nokia Graetz, Pforzheim, Fed. Rep. of Germany

[21] Appl. No.: 193,372

[22] Filed: May 12, 1988

Related U.S. Application Data

[63] Continuation-in-part of Ser. No. 108,066, Oct. 13, 1987, abandoned.

[30] Foreign Application Priority Data

Oct. 16, 1986 [DE] Fed. Rep. of Germany ..... 3636186

[51] Int. Cl.[4] ..... H01B 1/06

[52] U.S. Cl. ..... 252/511; 252/502; 252/506; 252/510

[58] Field of Search ..... 252/511, 502, 506, 511; 313/479, 480, 400; 524/495, 496

[56] References Cited

U.S. PATENT DOCUMENTS

| | | | |
|---|---|---|---|
| 3,923,697 | 12/1975 | Ellis | 252/506 |
| 4,038,091 | 7/1977 | Francel et al. | 501/15 |
| 4,098,611 | 7/1978 | Francel et al. | 501/15 |
| 4,099,977 | 7/1978 | Francel et al. | 501/15 |
| 4,547,310 | 10/1985 | Kasanami et al. | 252/511 |
| 4,613,375 | 9/1986 | Förster et al. | 252/511 |

*Primary Examiner*—Josephine Barr

*Attorney, Agent, or Firm*—Peter C. Van der Sluys

[57] ABSTRACT

A conductive suspension for making contact to the inside of a picture tube consists of graphite, glass-frit powder, a binder, such as nitrocellulose, a solvent, such as isoamyl acetate. It can be applied prior to or after the aluminizing process by various techniques, such as brushing, printing, or spraying, and permits the bake-out process and the frit-sealing process to be performed in one step because it is permeable to organic substances. It is easy to remove from defective tube parts by conventional cleansing techniques.

15 Claims, No Drawings

GRAPHITE-CONTAINING CONDUCTIVE SUSPENSION FOR PICTURE TUBES

CROSS-REFERENCE TO RELATED APPLICATIONS

This application is a Continuation-In-Part of U.S. application Ser. No. 108,066 filed Oct. 13, 1987 now abandoned.

BACKGROUND OF THE INVENTION

1. Field of the Invention

The present invention relates to a graphite-containing conductive suspension for making contact to the inside of a picture tube.

2. Description of the Prior Art

It is known that inside a picture tube, electric contact must be made between an aluminum film deposited on the panel by evaporation, a graphite coating on the inner sidewalls of the picture tube, and the anode contact sealed in the end of the tube neck. Such electric contacts are usually made during the fabrication of the picture tube by applying a graphite suspension to produce contact lines at the inner rim of the screen and a contact ring in the tube neck. The graphite suspension can be applied by printing, spraying, or with a brush, for example. After the contact lines have been applied to the inside of the screen, an aluminum film is deposited by evaporation in a high vacuum.

Before the funnel and the panel are joined together, the tube must be baked out to remove the organic ingredients. A solder-glass paste is applied to the edges of the panel and the funnel, and the two parts are fused together by hot sealing. This is usually followed by another bakeout process.

These known process steps for making picture tubes are described, for example, in the journal *Funk-Technik*, 1967, No. 15, pp. 576 to 580.

The graphite suspension commonly used to produce the electric connections inside the picture tube is a mixture of graphite and water glass. With this mixture, sufficient electric contact is achieved, but this suspension has the disadvantage of being impermeable to organic substances after hardening, so that organic substances below the conductive coating cannot be removed by bakeout. Therefore, the contact lines must be applied prior to the deposition of the aluminum film, or the aluminum film must be baked out before the contact lines are applied.

In addition, the known conductive suspension has the disadvantage of being difficult to remove from the glass parts of the tube, thus complicating the reuse of defective tube parts.

SUMMARY OF THE INVENTION

It is an object of the present invention to provide a conductive suspension which is permeable to decomposition products during the bakeout of organic ingredients without forming any blisters or without any exfoliation taking place, and which thus permits the bakeout process and the frit-sealing process in the fabrication of a picture tube to be carried out in one step.

It is another object of the invention to provide a conductive suspension which is easy to remove from defective parts of the picture tube by conventional cleansing processes.

The present invention contemplates a graphite-containing conductive suspension for making contact to the inside of a picture tube that, in addition to graphite, contains glass-frit powder, a binder, and a solvent. Preferably, the binder is nitrocellulose and the solvent is amyl acetate and, more particularly, isoamyl acetate or butyl acetate.

DESCRIPTION OF THE PREFERRED EMBODIMENT

In accordance with the present invention, a graphite-containing conductive suspension also contains a glass-frit power, a binder, and a solvent. The binder is preferably nitrocellulose, and the solvent is amyl acetate, prefereably isoamyl acetate or butyl acetate. The glass-frit powder can be anyone of the types usually used to join the faceplate and the funnel of a picture tube, such as 7590 Special 140P 2P 1 of Corning Glass Works, Corning, N.Y., in which 90% of the grains are less than 10 um in diameter. The Corning 7590 Special glass is a lead oxide sealing glass also containing zinc oxide, boron trioxide, and minor amounts of barium oxide and zirconium oxide.

The binder may alternatively be selected from methyl hydroxyl butyl cellulose, a water-soluble cellulose such as methyl cellulose or a water-soluble thickening agent such as polyvinyl alcohol. When a water-soluble binder is used, water is used as the solvent.

These ingredients are mixed with only a small portion of the solvent being first added to the binder to make a solution. The mixture is then thoroughly ground and homogenized in a ball mill about half of whose volume is filled with corundum balls. By subsequent addition of isoamyl acetate, the suspension can be set to the viscosity necessary for the respective method of application. The conductive suspension, in accordance with the invention, can be applied by printing, spraying with a finespraying device using a stencil, automatic brushing, or coating prior to or after the deposition of the aluminum film and with the shadow mask removed.

However, the conductive suspension, in accordance with the invention, can also be applied after deposition of the aluminum film with the shadow mask inserted, namely by spraying with a fine-spraying device or by automatic brushing.

The conductive suspension in accordance with the invention preferably has the following composition.

60 g of glass-frit powder
74 g of graphite powder
55 g of frit binder added as a solution comprising 17.5 g of nitrocellulose and 37.5 g of the solvent isoamyl acetate.
270 g of isoamyl acetate The amounts of the various components of the composition may vary over ranges as follows:

glass-frit power: 5 to 15 percent by weight
graphite powder: 5 to 20 percent by weight
frit binder: 0.1 to 5 percent by weight
solvent: 60 to 90 percent by weight When an amyl acetate is used as a solvent, it is preferable to limit the upper end of the range to 85 percent by weight.

The ingredients are ground and homogenized in a ball mill for 24 hours.

With the use of the conductive suspension in accordance with the invention, the bakeout process and the frit-sealing process for joining the tube parts together can be performed in a single step, because the conductive suspension passes the organic ingredients located there-below, thus permitting bakeout after its application and simultaneously avoiding any blistering or exfoliation of the conductive coating. The conductive suspension, in accordance with the invention, also prevents any chemical attack on the aluminum film and the underlying nitrocellulose film. It simplifies and reduces the cost of the fabrication of picture tubes.

The conductive suspension, in accordance with the invention, can be easily removed from defective tube parts by conventional cleansing techniques, so that reuse of these parts is readily possible.

What is claimed is:

1. A graphite-containing conductive suspension disposed on an inside surface of a picture tube and making electrical contact therewith, comprising:

5 to 20 percent graphite by weight;

5 to 15 percent lead oxide containing sealing glass-frit powder by weight;

0.1 to 5 percent binder, for said sealing glass-frit powder, by weight; and 60 to 90 percent solvent, for said binder, by weight.

2. A conductive suspension as claimed in claim 1, wherein the binder is nitrocellulose in an amount of 0.1 to 5 percent by weight.

3. A conductive suspension as claimed in claim 1, wherein the solvent is amyl acetate.

4. A conductive suspension as claimed in claim 3, wherein the solvent is isoamyl acetate in an amount of 60 to 85 percent by weight.

5. A conductive suspension as claimed in claim 1, wherein the solvent is butyl acetate.

6. A conductive suspension as claimed in claim 1, wherein the solvent is water in an amount of 60 to 90 percent by weight.

7. A conductive suspension as claimed in claim 1, wherein the binder is methyl hydroxyl butyl cellulose.

8. A conductive suspension as claimed in claim 1, wherein the binder is a water-soluble cellulose.

9. A conductive suspension as claimed in claim 8, wherein the water-soluble cellulose is methyl cellulose.

10. A conductive suspension as claimed in claim 1, wherein the binder is a water-soluble thickening agent.

11. A conductive suspension as claimed in claim 10, wherein the water-soluble thickening agent is polyvinyl alcohol.

12. A conductive suspension as claimed in claim 1, wherein the glass-frit powder is a lead oxide containing sealing glass frit.

13. A conductive suspension as claimed in claim 12, wherein the glass-frit powder further includes zinc oxide and boron trioxide.

14. A graphite-containing conductive suspension disposed on an inside surface of a picture tube and making electrical contact therewith, comprising:

5 to 20 percent graphite by weight.

5 to 15 percent lead oxide containing sealing glass-frit by weight; and a binder solution mixture of a binder and a solvent, said mixture being selected from a group of mixtures consisting of: nitrocellulose with amyl acetate, nitrocellulose with isoamyl acetate, nitrocellulose with butyl acetate, methyl hydroxyl butyl cellulose with amyl acetate, methyl hydroxyl butyl cellulose with isoamyl acetate, methyl hydroxyl butyl cellulose with butyl acetate, water-soluble cellulose with water, methyl cellulose with water, and polyvinyl alcohol with water, in each mixture the binder being provided in an amount of 0.1 to 5 percent by weight of the conductive suspension and the solvent being provided in an amount of 60 to 90 percent by weight of the suspension.

15. A conductive suspension as claimed in claim 14, wherein the sealing glass-frit further includes zinc oxide and boron trioxide.

* * * * *